United States Patent [19]

Des Ormeaux et al.

[11] Patent Number: 4,726,301

[45] **Date of Patent: * Feb. 23, 1988**

[54] SYSTEM FOR EXTRACTING CONTAMINANTS AND HYDROCARBONS FROM CUTTINGS WASTE IN OIL WELL DRILLING

[76] Inventors: Farrell P. Des Ormeaux, P.O. Box 32203; Thomas F. Des Ormeaux, P.O. Box 23303, both of Lafayette, La. 70593; Mark R. Des Ormeaux, 117 Township Ln., Apt. A, Lafayette, La. 70506

[ * ] Notice: The portion of the term of this patent subsequent to Aug. 19, 2003 has been disclaimed.

[21] Appl. No.: 840,067

[22] Filed: Mar. 17, 1986

Related U.S. Application Data

[63] Continuation-in-part of Ser. No. 711,590, Mar. 13, 1985, Pat. No. 4,606,283.

[51] Int. Cl.[4] ..... F23G 5/00; F23B 7/00

[52] U.S. Cl. ..... 110/250; 110/227; 110/228; 110/257; 110/234; 219/390; 219/388; 122/20 B

[58] Field of Search ..... 110/222, 224, 226, 227, 110/228, 234, 250; 122/20 B, 16, 17

[56] References Cited

U.S. PATENT DOCUMENTS

| | | | |
|---|---|---|---|
| 1,735,396 | 11/1929 | Hiller | 34/179 |
| 1,773,202 | 8/1930 | Rosenfield | 110/228 |
| 2,003,742 | 6/1935 | Elliott | 122/17 |
| 2,211,733 | 8/1940 | Soderberg | 432/154 |
| 3,395,241 | 7/1968 | Roman | 219/390 |
| 3,541,293 | 11/1970 | MacDonald et al. | 219/390 |
| 3,665,153 | 5/1972 | Asakawa | 122/17 |
| 3,991,821 | 11/1976 | Cook et al. | 122/20 B |
| 4,009,667 | 3/1977 | Tyer et al. | 110/234 |
| 4,089,277 | 5/1978 | Paul | 110/228 |
| 4,185,685 | 1/1980 | Gikerson | 122/20 B |
| 4,213,947 | 7/1980 | Fremont et al. | 432/72 |
| 4,261,795 | 4/1981 | Reilly | 110/257 |
| 4,351,250 | 9/1982 | Chartrand et al. | 110/227 |
| 4,356,778 | 11/1982 | McKee, Jr. | 110/234 |
| 4,385,568 | 5/1983 | Murray | 110/234 |
| 4,430,057 | 2/1984 | Hoover et al. | 34/179 |
| 4,470,359 | 9/1984 | Smith | 110/234 |
| 4,479,048 | 10/1984 | Kinoshita | 219/388 |
| 4,483,258 | 11/1984 | John et al. | 122/20 B |
| 4,485,746 | 12/1984 | Erlandsson | 110/234 |

FOREIGN PATENT DOCUMENTS

| | | | |
|---|---|---|---|
| 405137 | 10/1924 | Fed. Rep. of Germany | 219/390 |

*Primary Examiner*—Henry C. Yuen

*Attorney, Agent, or Firm*—Pravel, Gambrell, Hewitt, Kimball & Kriege

[57] ABSTRACT

A system wherein the contaminated cuttings are fed into the system for eventual incineration. The principal apparatus of the system comprises a plurality, preferrably three, of horizontally disposed cylindrical drying chambers mounted onto a skid for receiving contaminated cuttings into each separate chamber. There is provided on the first end of the chambers a receiving bin or hopper, wherein the cuttings are received from the shakers or the like into the bin, and dropped into an opening in the first end of the three chambers. Each chamber is provided with a seperate variable motor controlled auger disposed substantially throughout the length of the chamber wherein rotation of the auger would move the cuttings along the length of the interior of the chamber. The second end of each chamber is provided with a lower exit chute for removal of the cuttings from the chamber as the auger has moved into position. There is further provided a heat exchange means for drawing the hot exhaust gases from each chamber and reducing their temperature significantly, while also drawing oxygen into the heating chambers for providing the necessary oxygen for the incineration process.

14 Claims, 8 Drawing Figures

SYSTEM FOR EXTRACTING CONTAMINANTS AND HYDROCARBONS FROM CUTTINGS WASTE IN OIL WELL DRILLING

This application is a continuation-in-part of a prior application by the same inventors filed on Mar. 13, 1985, and entitled "System For Extracting Contaminants And Hydrocarbons From Cuttings Waste In Oil Well Drilling", bearing U.S. Ser. No. 711,590, now U.S. Pat. No. 4,606,283.

BACKGROUND OF THE INVENTION

1. Field of the Invention:

The system of the present invention relates to oil well cuttings. More particularly, the system of the present invention relates to an apparatus and process for extracting contaminants and hydrocarbon from cuttings wastes in oil base and water base drilling fluid systems.

2. General Background

In the field of the oi well drilling, during the process of drilling the well, drilling fluids are tuilized for several purposes, one of which is to be pumped downhole for flushing away the cuttings ass the drill bit cuts through the strata of earth. The cuttings are removed upward along the annular space between the drill string and the borehole, and are brought above ground.

In order to reuse relatively uncontaminated drilling fluid, the drilling fluid and cuttings that are brought up from the borehole are processed through a series of shale shakers and the like wherein the drilling fluid and cuttings are sifted so that the drilling fluid is allowed to flow back for reuse in the borehole, and the cuttings then are removed, often times to a waste pit or the like. At present, there are pending regulations which will require that the offshore waste pits be disallowed, therefore, there is an ever impending need for a means for disposal of cuttings which are usually highly contaminated with hydrocarbons or other fluids.

There is known in the art several apparatuses, one of which pertains to a conveyor system for moving the cuttings through a chamber wherein the cuttings are "fired" by flames in order to dry them to an ashen state and thus removed as dry cuttings. The shortcoming in this particular apparatus is that an open flame near the site of a borehole is extremely dangerous and is now disallowed under present federal and state regulations. Therefore, there is a present need for an apparatus or system wherein the cuttings can be dried and safely incinerated to remove athe hydrocarbons and other contaminats prior to the cuttings being hauled away and either stored or used for other purposes after decontamination.

An additional conventional method available is the cuttings washer system which is a very expensive system to utilize ranging from $ 300 to $ 600 per day plus the additional cost of an emulsifier or soap to supply the cutitngs washer with dispersing capabilities. Because of recent restrictions, it becomes necessary to collect the cuttings in 25 to 50 gallon barrel tanks which must be transported to dock site and further transported to a waste disposal site. The cost for disposal of this waste ranges from $ 8 to $ 20 a barrel thus the total costs of the washer system ranges to a $ 2,500 per day cost.

SUMMARY OF THE PRESENT INVENTION

The system of the present invention solves the problems and shortcomings in the art in a straightforward manner. What is provided is a system wherein the contaminated cuttings are fed into the system for eventual incernation. The principal apparatus of the system comprises a plurality, preferably three, horizontally disposed cylindrical drying chambers mounted onto a skid for receiving contaminated cuttings into each separate chamber. There is provided on the first end of the chamber a receiving bin or hopper, wherein the cuttings are received from the shakers or the like into the bin, and dropped into an opening in the first end of the three chambers. Each chamber is provided with a separate variable motor controlled auger disposed substantially throughout the length of the chamber wherein rotation of the auqer would move the cuttings along the length of the interior of the chamber and crush the cuttings as they are moved along. The second end of each chamber is provided with a lower exit chute for removal of the cuttings from the chamber as the auger has moved them into position. The cuttings would then be collected in a polyurethane bag or the like.

Each chamber is further provided with an interior wall and an exterior wall, and an annular area therebetween which houses a heating source for intense heating of the interior of the chamber during the process. For the drying and incineration of the cuttings as the cuttings are driven and crushed through the length of the chambers by the auger, this heating source in the wall of the chambers further provides a plurality of electrically heated rods inserted in the annular space and adjacent to the interior wall of the chamber, extending substantially throughout the length of each chamber. The series of 18 rods are so situated as to supply an even distrubution of heat into the interior of the chamber during the movement of the wastes therethrough so that the heating rods, which perferably provide each chamber with 800 to 850 degrees of optimum heat for incineration of the hydrocarbons, also has the capability to heat each chamber up to a maximum of 1600 degrees. In order to further enhance conductivity of the interior wall of the chamber for providing an evenly distributed layer of heat throughout, there is provided a continuous coating of graphite paint or cement which coats each heating rod and further provides a continous surface from the heating rod onto the outer interior wall of the chamber for conducting heat along that entire interior wall. In the annular space between the heating rods and the exterior wall there is provided a quantity of insulation material insuring that the heat provided by the rods is directed towards the interior of the chamber and not out toward atmosphere.

There is provided an upper exhaust opening on each chamber, which could be fitted with a catalytic converter of activated charcoal or the like for allowing venting to atmosphere of poisonous gases from the wastes that are being incinerated within the chamber during the drying process. A fan is situated atop each exhaust in order to force air through the chambers during the drying process, to remove gases therewithin. In addition, there is provided a plurality of hinged door members on the upper surface of each chamber for easy access into the chamber should an auger become blocked by larger cuttings or the like.

In the improved embodiment of the present invention, there is further included a system for cooling the exhaust gases that are released from the drying chamer of the apparatus, which would include a heat exchanger wherein the gases exiting the heating chambers at approximately 800 to 900 degrees F. or flow through a water jacket wherein the heat from the hot gas is exchanged into the cooler flowing water, and the temperature of the gas is reduced down to 90 degrees F., prior to exiting into ambient atmosphere. In addition, the hot gases are drawn through the heat exchanger via a fan mounted atop the exchanger so that in addition, to drawing the hot gases therethrough, oxygen is drawn throughout the length of the chambers, both through the hopper and through the exit chutes of the drying chambers, therefore, providing the much needed oxygen in the drying chambers for proper incineration.

Therefore, it is a principal object of the present invention to provide a system for decontaminating oil well cuttings, the system having a unique capability to remain explosion proof under extremely dangerous conditions in close quarters on limited space facilities on offshore rigs;

It is a further principal object of the present invention whereby utilizing an air emission scrubber which forms a strong vent of air through the system, therefore making the system safe against dangerous natural gas leaks.

It is still a further principal object of the present invention to move approximately 1000 cubic feet of air a minute through the intake and discharge, therefore irritating the system causing a series of small controlled explosions within the system, do to the large availability of oxygen;

It is still an object of present invention to through the induction of oxygen into the system, causes an oxidation process for burning the harmful nitros-oxide gases produced by the hydro-carbons;

It is still a further object of the present invention to cool the emissions produced by the heat of the ignition of hydro-carbons within the system chambers by the use of a water jacket surrounding the scrubber, so that there is a constant flow of cool water being circulated through and around all of the openings which are emitting heat and burned out gases from the system;

It is still a further object of the present invention to reduce the temperature of the incinerate exhaust gases from approximately 650 degrees F. down to approximately 85 degrees F., therefore making the exhaust gases safe when or if exposed to heat sensitive gases;

It is still a further object of the present invention to utilize the process of creating a constant flow of air through the openings of the system moving inward, therefore taking in all gases around the system and not allowing any heat generated from within the system either from ignition of hydro-carbons from the solid waste or from extraneous free flowing natural gas from outside entering the system, from causing an outward flash, which then could cause dangerous fires.

BRIEF DESCRIPTION OF THE DRAWINGS

For a further understanding of the nature and objects of the present invention, reference should be had to the following detailed description, taken in conjunction with the accompanying drawings in which the parts are given like reference numerals and wherein.

DETAILED DESCRIPTION OF THE PREFERRED EMBODIMENT

Figure 3:
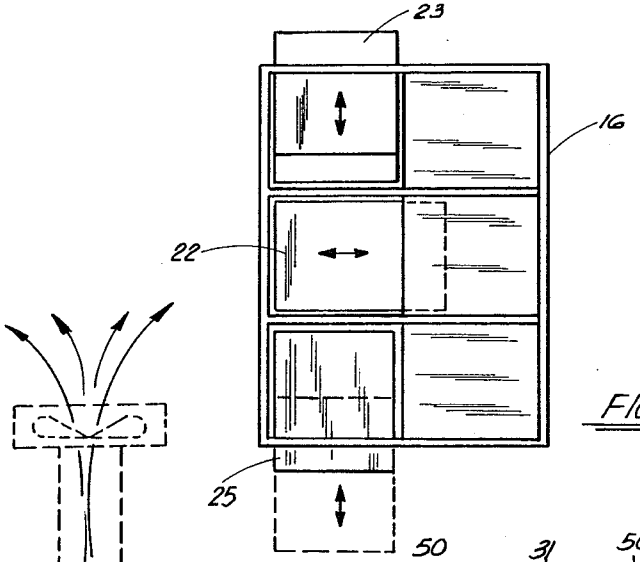
FIG. 3 is a top view of the receiving bin portion of the apparatus of the present invention.
Figure 4:
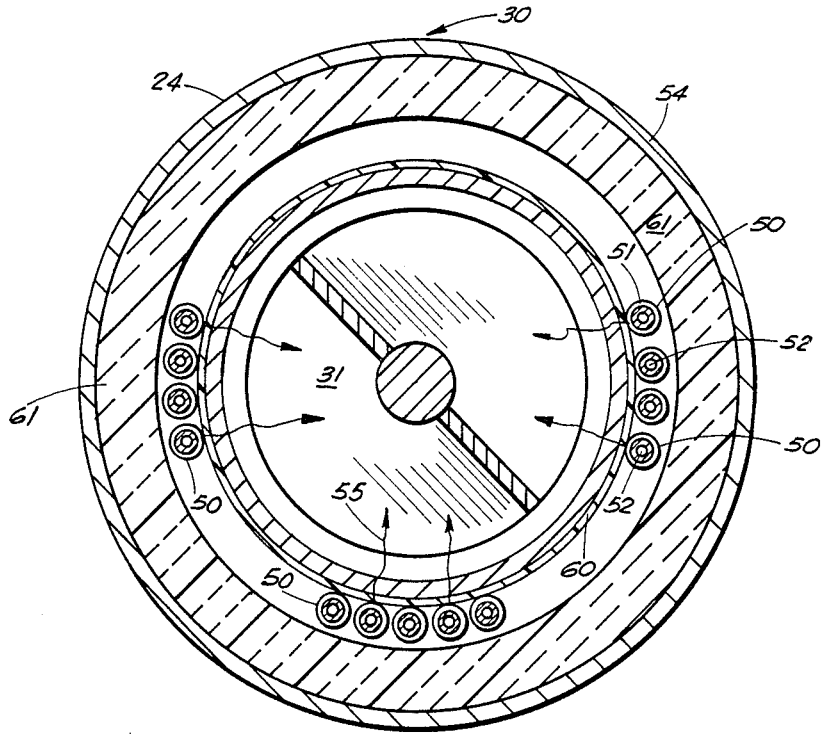
FIG. 4 is a cross-sectional view through a drying chamber of te apparatus of the present invention illustrating the coating material around the interior of the chamber in the system of the present invention.

FIGS. 1–8 illustrate the system of the present invention by the numeral 10. Apparatus 10 would generally comprise a rigid base skid portion 12 which would be constructed of angle iron or the like for providing a secure foundation for apparatus 10. Each of the corners of the base portion further provide a lift arm 14 for providing means for lifting the entire apparatus onto and off to a rig site or the like. Mounted upon skid 12 there is first provided collection bin or hopper 16 which would generally comprise a top open ended collection bin for allowing waste cuttings from the shale shakers (not shown) to fall thereinto as illustrated by ARROWS 18 with the cuttings moving into chutes 19, 20 and 21 of bin 16. So as to regulate the flow of cuttings down the three respective chutes, there is further provided slidable plate means, (for example, 22, 23 and 25 as seen in FIG. 3), which are slidably movable to adjust the flow opening through chutes 19, 20 and 21 as the cuttings move down into the main drying chamber.

As seen in the FIGURES, each chute 19, 20 and 21 allows cuttings to fall into each separate means 30 for drying and incinerating cuttings during the process. This drying means 30 would generally comprise three seperate horizontally disposed drying and incinerating chambers respectively 24, 26 and 28. As seen in the FIGURES, each chute 19, 20 and 21 would empty into an upper opeining of each horizontally disposed drying chamber for collection of the cuttings thereinto. As is seen in FIG. 3, there is further provided auger 31 which is disposed substantially through- out the length of each horizontal drying chamber 24, 26 and 28 so that rotation of the auger would break the larger cuttings up into smaller cuttings to provide a greater surface area for drying out and would also move the cuttings through the chamber in the direction of ARROW 32. At the second end portion 34 of each drying chamber 24, 26 and 28 there is provided an exit chute 36 allowing the cuttings to fall out of each drying chamber into a polyurethane bag 38 or the like as seen in phantom view.

Rotation of each auger 31 in each of the seperate drying chambers is provided by a variable speed hydraulic motor 40 which is directly linked to each seperate auger 31 so that rotation of the shaft of motor 40 would impart likewise rotation to auger 31 within each of the drying chambers. Therefore, if one wished to operate a single chamber or a pair of chambers, one could close off a respective bin and open other respective bins and operate the chambers accordingly. As seen also mounted on skid 12, there is further provided main power units 40, 42 and 44 and control panel 45 which serves as a means to regulate and control the electrical supply boxes for operation of the variable hydraulic motors 40 and other electrically operated features of the system which will be discussed further. Also, there is provided main electrical motor 46 which provides the power to operate hydraulic motors 40.

As the cuttings are moved and crushed to smaller components through each horizontally disposed chamber 24, 26 and 28 respectively, via the rotation of auger 31 within each of said chambers, there is provided means for drying and incinerating the cuttings as they are moved from the point of entry at the first end of each chamber to the point of exit through chute 36 of each of the chambers. As seen particularly in FIGS. 2 and 4, this means for drying and incinerating the contaminated cuttings, would comprise a plurality of heating elements 50, and as seen in FIG. 3, each of said heating elements 50 comprising a metallic heating rod 52 disposed horizontally between inner wall 53 and outer wall 54 of each of said chambers. As seen in the cross-sectional view in FIG. 4, there would preferably be provided a series of four heating elements 50 along one side wall of each chamber, a series of four heating elements 50 along a second side wall of the chamber and a series of five heating elements 50 along the bottom portion of the chamber wall. As further seen in the FIGURES, each of the heating elements 50 would be adjacent the inner wall 53 of each chamber so that heat would be more properly directed inwardly toward the interior of chamber 58 as seen by ARROWS 55, with a layer of insulation material 61 between the heating elements 50 and the exterior wall 54 of each of the chambers to assure directing heat inwardly toward the interior of each chamber 58.

Most crucial to the heating ability of the heating elements in obtaining the requisite heat, i.e., optimumly between 800 and 850 degrees to a maximum of 1600 degree F. within each of the chambers during the drying and incinerating process, there is further provided means for evenly distributing the heat around the circumferential inner wall 53 of each of the chambers. This means for distributing the heat would comprise a layer of paint 60 which contain approximately 12% or more graphite material for serving as a heat conductor, thus conducting even heat throughout the internal heating chamber and not the radiation of the heat, to insure that the heat provided by rods 50 is evenly distributed through a "blanket" coating through the inner chamber wall. In the preferred embodiment, each rod 50 would be inserted into tube or element casing 51, which would be thoroughly coated with a cement or paint layer 60 and serves as a cintinuous coating for the entire outer interior wall of each chamber. This cement or paint layer 60 would conduct heat from each heating element to be evenly distributed around the wall of the chamber and would allow substantially equal heating throughout the circumference of the interior wall, therefore providing more thorough drying of the cuttings within the interior of each chamber as the cuttings move therethrough. Further, inside of each heating element casing 51, there is further provided a magnesium oxide powder which is utilized to conduct the heat directly from the element through the heating element casing 51, and through the heat graphite compound directly to the inner chamber wall thus making the heating of the system more efficient.

As seen in the FIGURES, each of chambers 24, 26 and 28 would be further provided on the upper portion with a series of hinged metal door covers 70 wherein the opened position would provide access to augers 31 so that auger 31 could be cleared or cleaned while the process is not ongoing. Further, when the chamber doors 70 are in the closed position, each would be secured by bolts 72 so that any explosions or intense heat occurring through the chamber during the incinerating process would be closed to the atmosphere and would be internal within the chamber, thus preventing any possibility of explosion or the like during the process.

As seen in the Figures there is further provided an exhaust outlet 80, 82 and 84 in each of the chambers respectively, for allowing the exhausting of gases during the incinerating process. Each exhaust could be further provided with a catalytic converter 65 or the like filter with volcanic rock and activated charcoal or the like for neutralizing and gases that are vented to the atmosphere during the incinerating process. In addition, if necessary, a scrubber or the like could be provided as a further means for cleaning the off gases. Situated atop each catalytic converter 65, there would be provided a suction fan 67, for drilling gases from within each chamber 24, 26 and 28, during the decontamination, through filter elements or catalytic converter 65, and cleaning of the off gases, prior to venting to atmosphere.

Figure 7:
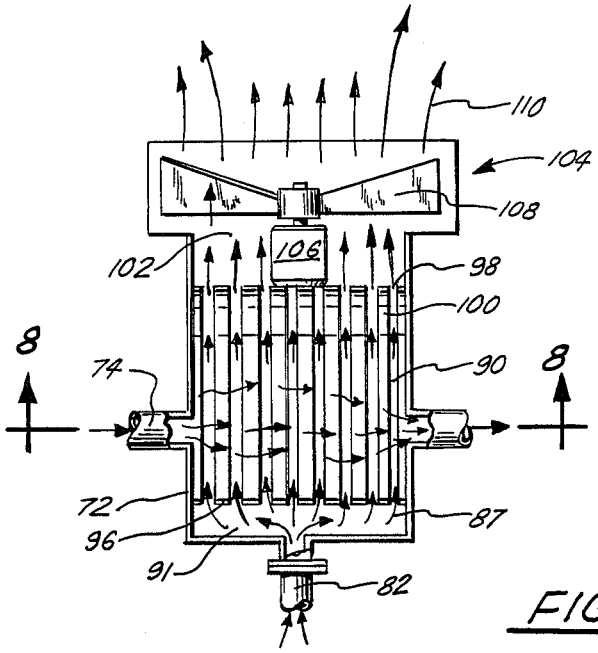
FIG. 7 is a cross-sectional view of the cooling chamber in the alternate embodiment of the apparatus of the present invention.

FIG. 7 represents an improved embodiment of the apparatus of the present invention. The improvement comprising a means for cooling and cleaning the exhaust gases that are emitted from the drying unit and for maintaining the electrical components of the system out of the range of the intense heat generated by the drying chambers.

For matter of convenience in the explanation of the functioning of the improved embodiment, reference can be continued to be had to the numerals as for the components of the system as seen in the preferred embodiment, and a thorough discussion will be had of the improvements as illustrated in FIGS. 5–8.

Figure 1:
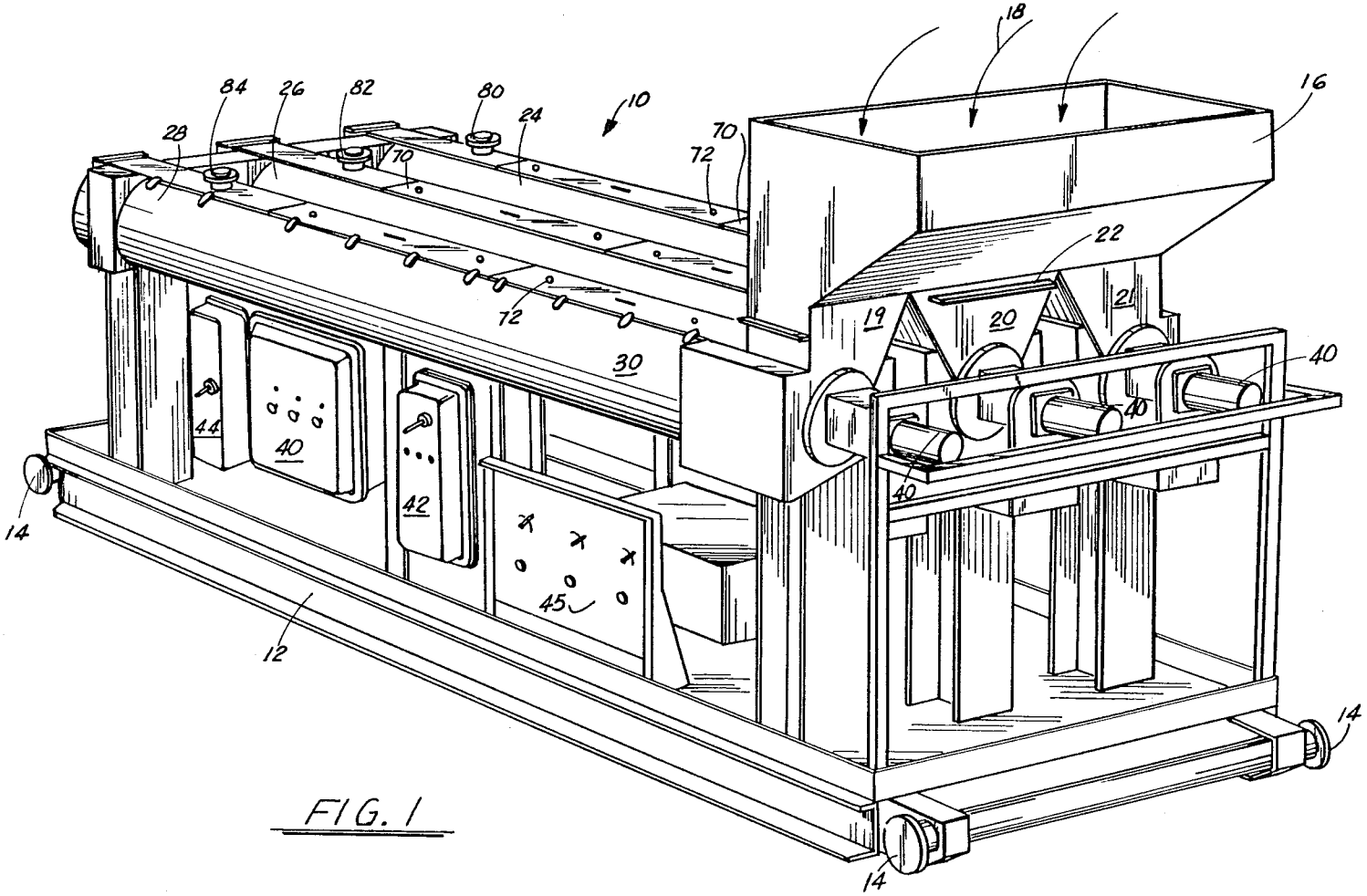
FIG. 1 is an overall perspective view of the principal apparatus of the system of the present invention.
Figure 2:
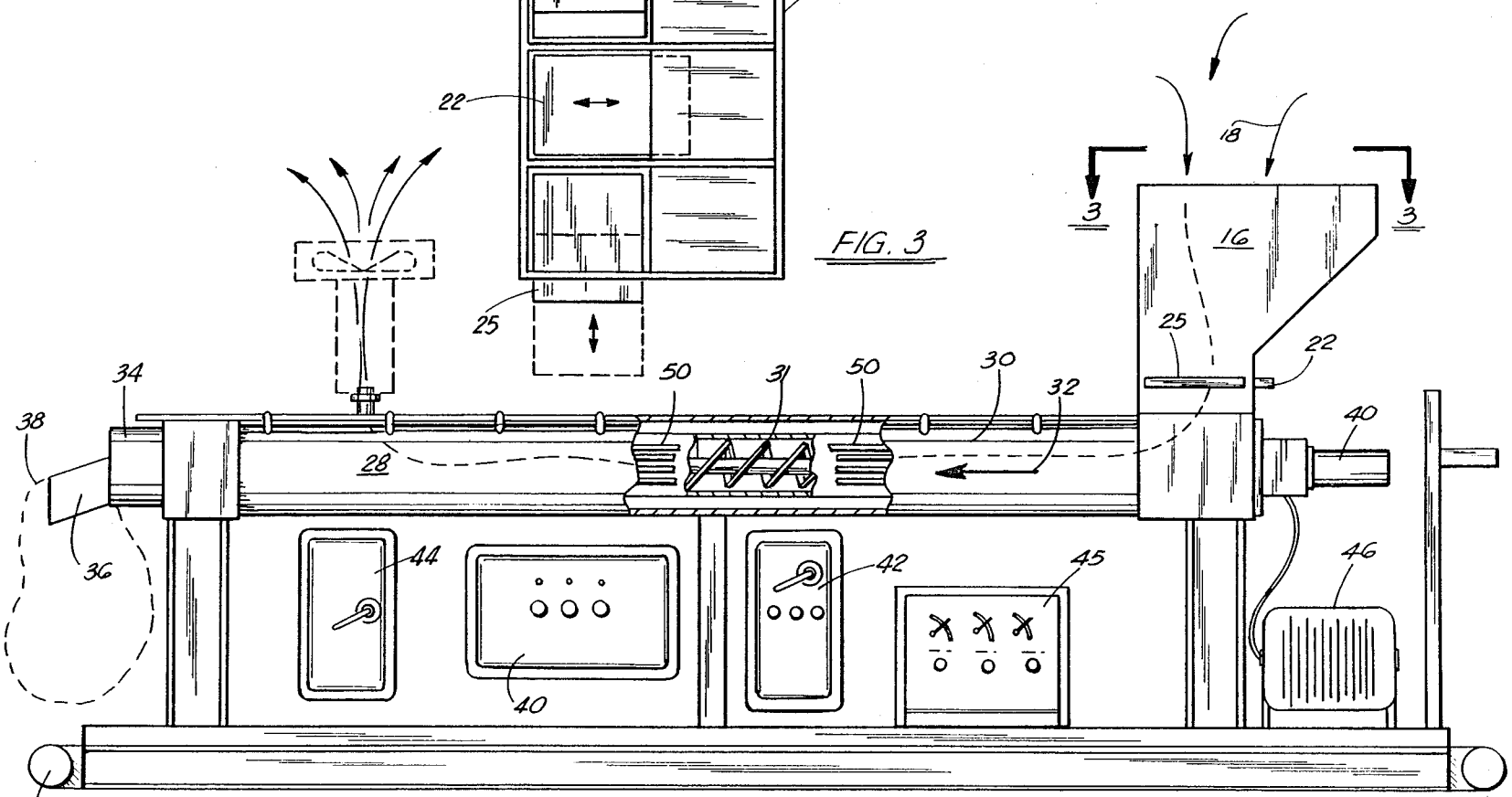
FIG. 2 is a partial cutaway side view of a drying chamber of the system of the present invention.
Figure 5:
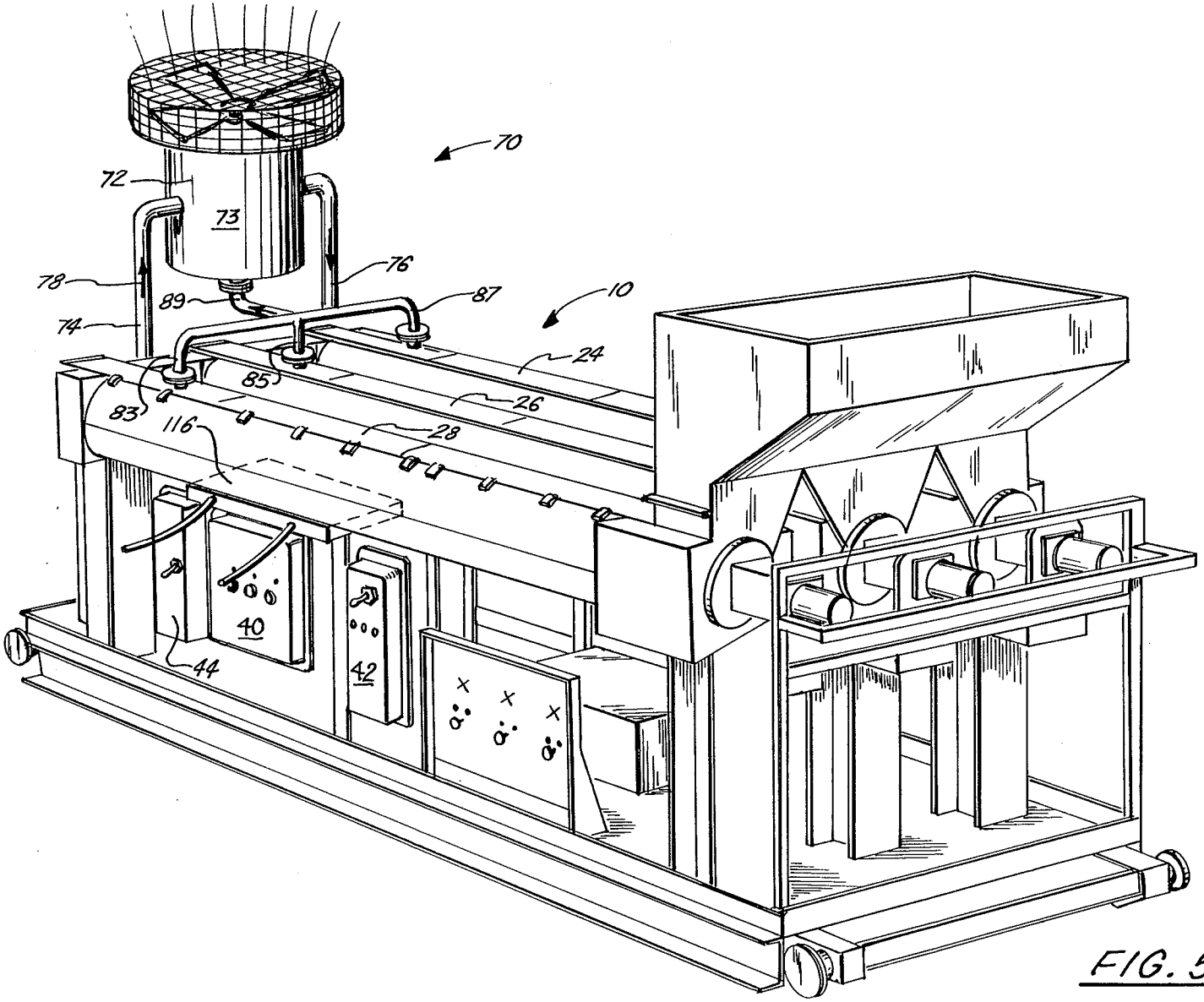
FIG. 5 is an overall perspective view of an alternate embodiment of the system of the present invention.
Figure 8:
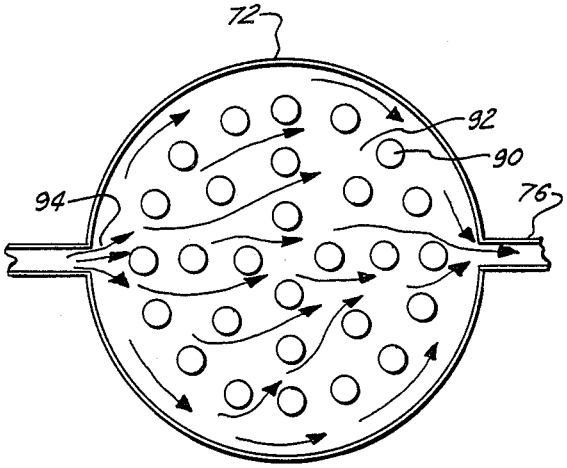
FIG. 8 is a top view along lines 8.8 in FIG. 7 of the cooling chamber of the alternate embodiment of the apparatus of the present invention.

Turning now to FIG. 5, which illustrates the overall perspective view of the improved embodiment, apparatus 10 in addition to the components as seen in FIG. 1 of the original embodiment, would further comprise a gas cooling and cleaning means 70 which is illustrated in detail in FIGS. 7–8 as will be discussed further. As seen in the FIGURES, cleaning and cooling means 70 comprises a principal cooling chamber 72 which, in the preferred embodiment is cylindrical in shape, the internal chamber formed by outer wall 73 as seen in the FIGURES. Cooling chamber 72 is mounted on apparatus 10 through bracing 75 (See FIG. 6), extending from the upper portion of the apparatus 10 onto the side wall 73 of the cooling chamber 72, and the lines 76 and 78 feeding into the chamber 72. As seen particularly in FIG. 1, there is provided a water inlet line 74 and a water outlet line 76 leading into and out of the side wall 73 for providing a continuous flow of water through cooling chamber 72 as seen by ARROW 78. The flow of water through lines 74 and 76 is derived from water tank 80, as seen in FIG. 8, mounted adjacent apparatus 10 and having principal flow line 81 for pumping water through line 74 into cooling chamber 72. Further, as seen in the FIGURES, chamber 72 also receives the exhaust gases from the three (3) drying chambers 24, 26 and 28 respectively, through three (3) feeder lines 83, 85 and 87 respectively to converge into principal exhaust flow line 89 feeding into the bottom 891 of cooling chamber 72. As seen in cross-section, exhaust flow line 89, flows into a receiving chamber 91 of cooling chamber 72. The gas, as illustrated by ARROWS 87, flows into a plurality of flow pipes 90, as seen particularly in cross-sectional top view in FIG. 8. The gas, of course, that enters receiving chamber 86 is of intense heat up to 600 to 700 degrees F., and must be cooled considerably.

This cooling is achieved by the water flowing through line 74 into the space 92 within chamber 72 surrounding the gas flow pipes 90 as seen particularly in FIGS. 9 and 10. FIG. 10 illustrates with clarity, the flow of the water as depicted by ARROWS 94 entering into chamber 72 flowing about and around piping 90, and exiting through chamber 72 via line 76. While flowing through chamber 72 the water contained in the space 92 and the gas contained in piping 90 is in heat exchange relationship, with the heat moving from the exhaust gas into the flow of cold water there around, and the water flowing out line 76 having picked up a considerable amount of heat from the hot gases.

As seen particularly in FIG. 7, the gas flowing within gas pipes 90 is maintained apart from the water flowing within the upper portion of chamber 72 via a baffle plate 96 which extends across the lower portion of chamber 72 seperating chamber 72 into the lower hot gas receiving space and the upper water flow space, so that the heat exchange relationship may take place between the hot gases and cool water. Of course, the individual pipes 90 are in fluid communication between the lower gas receiving space 86 and the bores within piping 90 flowing to the top portion of chamber 72. Further, so that the water flow does not spill over into the open ends 98 of pipes 90 there is provided a second baffle plate 100 which serves to confine the water within water flow space 92. Following the cooling of the gas as it flows through tube piping 90, the cool gas upper receiving space 102, and is drawn out of the cooling chamber via the rotation of fan means 104 which comprises an electrically run fan motor 106 and a fan blade 108 for drawing the cooled gas out of the apparatus vented into atmosphere. For purposes of the apparatus, the gas which is exiting the cooling unit 72 as seen by ARROWS 110 is of a temperature not exceeding 90 degrees F.

During the drying and incinerating of the waste moved through the burning chamber 24, 26 and 28, in order for proper ignition and incineration to occur, it is necessary that a constant flow of oxygen be maintained into the chambers. As seen in the FIG. 6 in cross-sectional view, this flow of oxygen is easily maintained through the cooling means as will be explained fully.

As was discussed earlier in the operation of the apparatus, the initial wastes are dumped into hopper 16 and flow into the various incinerating chambers 24, 26 and 28. As the product moves through the incinerating chambers, the incinerating occurs, and the incinerated ashes and material solid waste falls from shoot 19, 20 and 21 into waste sacks or the like. For purposes of illustration in FIG. 6, we have illustrated the chute as being chute number 19. Therefore, there is a constant course of flow between the opening of hopper 16 and the opening of chutes 19, 20 or 21 during the incinerating process. Therefore, when fan means 104 is put into operation in order to draw the gas fumes 87 into the cooling chamber, there is a low pressure created within the various lines 83, 85 and 87 therefore oxygen from the ambient atmosphere is pulled into the incinerating chambers 24, 26 and 28 through the opening in hopper 16, the flow as illustrated by ARROWS 112, and through the opening of chutes 19, 21 and 23 as illustrated by ARROWS 114, with the oxygen flowing into lines 83, 85 and 87 together with the gases that are being emitted from the incinerating of the product. Therefore, the cooling means, in addition to serving as a means for cooling the hot gases that are emitted from the apparatus, also serves as a means for assuring that the oxygen flow within the incinerating chambers is maintained at a level necessary to maintain incineration during the process and to oxidate fully all toxious gases, such as nitrous oxide.

FIG. 5 also illustrates an additional item where water flow takes place during use of the system. As seen in FIG. 5 and as was seen in FIG. 1, the electrical system designated by the numerals 40, 42 and 44 are directly adjacent the under wall of the various incinerating chambers 24, 26 and 28. Therefore, experience has it that these electrical systems are subject to intense heat radiating from the incinerating chambers, and may do damage to these particular electrical systems. Therefore, the improved embodiment provides an additional heat exchanger 116 which would generally comprises a rectangular chamber positioned intermediate the electrical systems 40, 42 and 44 and the incinerating chambers, with an inlet cool water line 118 and outlet water 119 which would provide a constant flow of water through heat exchanger 116. Therefore, as heat would be radiated downward to the electrical systems, the water in the heat exchanger could pick up the heat from the chambers, and therefore very little heat would be allowed to be radiated downward into the electrical systems. This would improve the overall life of the system in its use.

Figure 6:
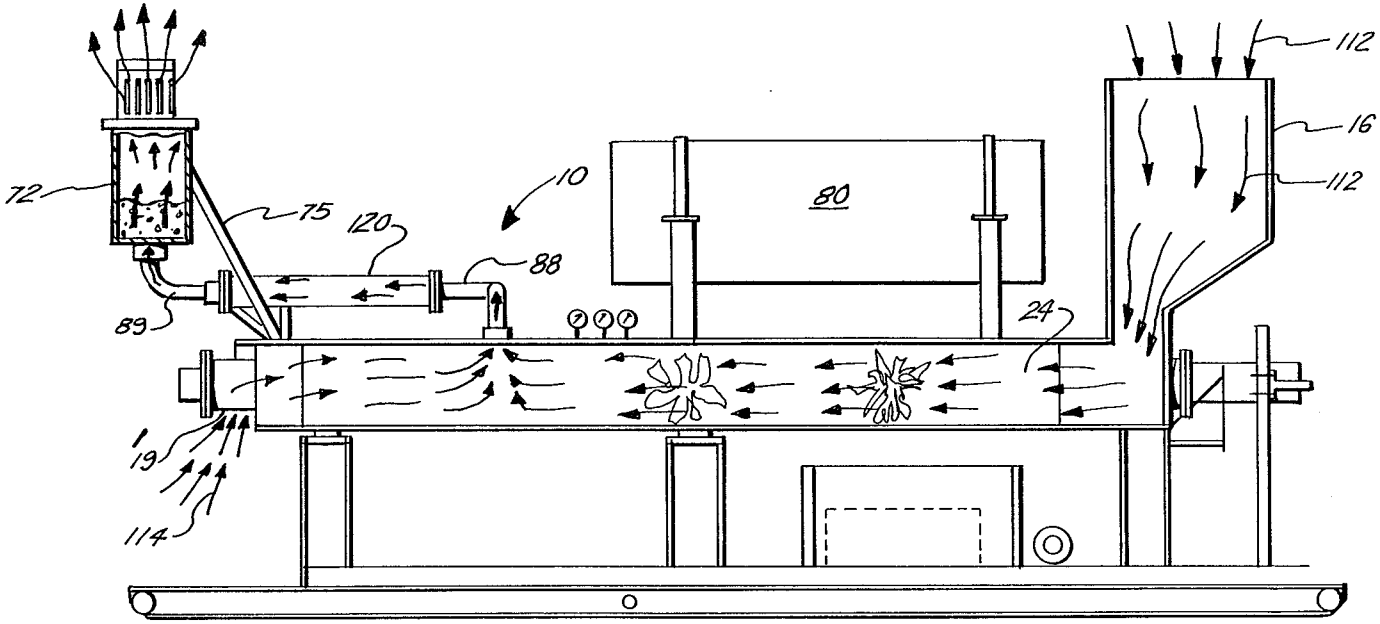
FIG. 6 is a cross-sectional view through the drying chamber of an alternate embodiment of the apparatus of the present invention illustrating the means for drawing in and cooling the exhaust gases that are emitted.

FIG. 6 further provides that in addition to the cooling means 72, there could be provided a catalytic converter 120 such as an air emission scubber, which would generally be positioned within main gas inlet line 88 so as to cleanse any of the hot gases being exited prior to the hot gases flowing into heat exchanger 72 for venting into atmosphere. This would be an additional preventive measure to assure that any possible toxic gases would not be vented out to atmosphere during the use of the system.

The apparatus 10 as seen in the process could process approximately 25,000 to 40,000 pounds of cutting or mud waste per hour or between 25 to 40 barrels of cutting waste per hout. In the event the cuttings would be part of a thickened "gumbo" from downhole, an emulsifier or the like could be added to the cuttings for more easily destribution by the auger and drying and incinerating. Overall, the system utilizing the novelty of an internal electrical heating source would provide an economical and safe means for the ever increasing problem of drying and decontaminating cuttings from the well site.

Overall, the system would normally require approximately four minutes for the routing of the cuttings through each drying chamber. If necessary, in view of the fact that the auger motors are variable in speed, the process could be reducted in time, therefore, allowing more internal heating time to ensure complete drying. In the perferred embodiment, each drying chamber would be approximately 13 feet in length, with the entire unit occupying approximately 20 feet in length. Also, in the perferred embodiment, the interior diameter of each heating chamber would be approximately 10 inches, with a 9½ inch auger, therefore providing approximately ¼ inch space between the interior wall and the edge of the auger blade for the movement of cuttings through the drying chamber. As was stated earlier, the entire apparatus is controlled via the electrical system, wherein each drying chamber is provided with a seperate control gauge and with a seperate temperature gauge wherein there is provided a first dial for selecting the desired temperature, and a thermostat whereby when that desired temperature is reached, the heating elements are shut off until there is a need to bring the temperature back up to the desired temperature or wherein the heating elements are electronically reheated automatically. Also, in the preferred embodiment, should there be a defect or breadage in one of the heating elements, the heating rods may be pulled from the housing that they are placed into in the chamber, and replaced with a workable heating element within the apparatus.

Because many varying and different embodiments may be made within the scope of the inventive concept herein taught, and because many modifications may be made in the embodiment of the law, it is to be understood that the details herein are to be interpreted as illustrative and not in a limiting sense.

What is claimed as invention is:

1. A system for decontaminating wet oil well cuttings, comprising:

a. at least one chamber portion for receiving the wet contaminated cuttings thereinto;

b. auger means contained within the chamber portion for moving and crushing the cuttings as the cuttings move along the length of the chamber portion;

c. heating means substantially surrounding the chamber portion for providing sufficient heat into the chamber portion for drying decontaminating and incinerating the cuttings, the heating means including a plurality of electrical heating rods disposed within the internal wall of the drying chamber and positioned radially around the chamber wall;

d. means for drawing oxygen into the chamber portion sufficient to provide ignition of the cuttings as they move through the chamber portion;

e. heat conducting means comprising a continuous layer over the chamber wall forming a composite layer with the wall of the drying chamber that is positioned between the heating rods and the wall of the drying chamber for providing uniform conduction of heat from the rods into the chamber along substantially the entire length of the chamber; and f. heat exchange means for receiving the hot exhaust gases from the incinerated cuttings, and reducing the temperature of the hot gases to a degree for release to ambient atmosphere.

2. The system in claim 1, wherein the temperature of the hot gases is reduced from 600 degrees F. to a temperature not to exceed 1000 degrees. F.

3. The system in claim 1, further comprising means for regulating the heat within the chamber portion during decontamination.

4. The system in claim 1, wherein the means for drawing oxygen into the chamber provides a fan positioned atop the heat exchange means for drawing oxygen through the chamber portion during the incineration process.

5. The system in claim 1, further comprising means to vary the speed of movement of the cuttings through the chamber portion.

6. The system in claim 1, wherein the temperature within the chamber portion is optimumly between 800 and 900 degrees F.

7. The system in claim 1, wherein means for moving the cuttings is a variable speed auger contained within the length of the chamber.

8. A system for drying, decontaminating, and incinerating oil well cuttings containing water, comprising:

a. a plurality of separate chambers, having first and second end portions, each of the chambers defining an incinerating chamber for receiving contaminated oil cuttings at the first end of each of the incinerating chambers;

b. auger means disposed substantially within the length of each of the incinerating chambers for moving the cuttings between the first and second end of each of the incinerating chambers;

c. heating means including electrical heating rods, contained within the length of the wall of each of the incinerating chambers for providing sufficient heat within each of the incinerating chambers to a temperature of at least 750 degrees F. for drying, decontaminating and incinerating the cuttings, the heating means including heat conducting means comprising a continuous layer over the chamber wall forming a composite layer with the wall of the drying chamber that is positioned between the heating rods and the wall of the drying chamber for providing uniform conduction of heat from the rods into the chamber along substantially the entire length of the chamber;

d. exhaust means in communication with each of the incinerating chambers for exhausting gases from the incinerating chambers during incineration of the cuttings; and e. heat exchange means in communication with the exhaust means, for providing a flow of cool fluid to receive heat from the hot gases of the incinerating chambers, to reduce the temperature of the gases so that the gases to a degree for exhaust into ambient atmosphere.

9. The system in claim 8, wherein there is further provided means for moving oxygen through the system for errating the system during the incinerating process.

10. The system in claim 8, wherein the gases exit the heat exchanger at a temperature not to exceed 90 degrees F.

11. The system in claim 8, wherein the heat exchange means comprises:

a. a chamber portion for receiving cool water flow thereinto;

b. a plurality of pipes positioned within said chamber, each of said pipes flowing hot exhaust gases therethrough; and c. water inlet means into the chamber for coursing cool water throughout the cooling chamber for transfering heat from the hot exhaust gases into the cool water, so that the exhaust gases exit the cooling chamber at approximately ambient temperature.

12. The apparatus in claim 8, further providing means communicating with each of the drying chambers for allowing heat exhausting of gas during the drying, decontaminating and incinerating process.

13. The apparatus in claim 8, further comprising a fan mounted in relation to the heat exchanger, for drawing the exhaust gases from the heating chamber during the incineration process and for drawing air into the heating chamber for providing the necessary oxygen to accomplish the incineration process.

14. An apparatus for drying, decontaminating and incinerating oil well cuttings containing water and hydrocarbons, the apparatus comprising:

a. a base portion;

b. at least one horizontally disposed chamber mounted on the base portion, the chamber having a first end for receiving the well oil well cuttings thereinto;

c. auger means disposed substantially within the length of the chamber for moving the cuttings from the first end to the second end of the chamber;

d. means housed within the wall of the chamber, substantially surrounding the chamber along its entire length, for providing heat within the chamber to a temperature of at least 700 degrees F. for drying and incinerating the wet oil well cuttings moving through the chamber, the means including a plurality of electrical heating rods disposed within the internal wall of the drying chambers, and further comprising heat conducting means comprising a continuous layer over the chamber wall forming a composite layer with the wall of the drying chamber that is positioned between the heating rods and the wall of the drying chamber for providing uniform conduction of heat from the rods into the chamber along substantially the entire length of the chamber;

e. heat conducting means positioned between the heating rods in the wall of the drying chamber for providing a means for uniformly conducting heat from the rods into the chamber along substantially the entire length of the chamber wall; and f. heat exchange means for reducing the temperature of the exhaust gases from each of the incinerating chambers to a temperature not to exceed 90 degrees F.

* * * * *